US010597195B2

(12) United States Patent
Beer

(10) Patent No.: US 10,597,195 B2
(45) Date of Patent: Mar. 24, 2020

(54) METHODS OF MAKING GUSSETED FLEXIBLE PACKAGE WITH SHAPED SIDES

(71) Applicant: Fres-co System USA, Inc., Telford, PA (US)

(72) Inventor: Jeffrey Scott Beer, Coopersburg, PA (US)

(73) Assignee: Fres-co System USA, Inc., Telford, PA (US)

( * ) Notice: Subject to any disclaimer, the term of this patent is extended or adjusted under 35 U.S.C. 154(b) by 286 days.

(21) Appl. No.: 15/661,071

(22) Filed: Jul. 27, 2017

(65) Prior Publication Data

US 2017/0320632 A1 Nov. 9, 2017

Related U.S. Application Data

(62) Division of application No. 13/692,139, filed on Dec. 3, 2012, now abandoned.

(Continued)

(51) Int. Cl.
*B65D 30/20* (2006.01)
*B31B 70/20* (2017.01)

(Continued)

(52) U.S. Cl.
CPC ..... *B65D 31/10* (2013.01); *B31B 70/20* (2017.08); *B31B 70/60* (2017.08); *B65B 43/04* (2013.01);

(Continued)

(58) Field of Classification Search
CPC ..... B31B 2150/00; B31B 2150/002; B31B 2155/00; B31B 2155/002; B31B 2160/20;

(Continued)

(56) References Cited

U.S. PATENT DOCUMENTS 3,785,112 A 1/1974 Leasure et al.
4,518,087 A * 5/1985 Goglio ..... B29C 65/18 383/210

(Continued)

FOREIGN PATENT DOCUMENTS

| | | |
|---|---|---|
| DE | 19603371 A1 | 8/1997 |
| FR | 2801280 A1 | 5/2001 |
| WO | 01/23271 A2 | 4/2001 |

OTHER PUBLICATIONS

International Search Report for PCT/US2012/067707 dated May 28, 2013.

*Primary Examiner* — Andrew M Tecco
*Assistant Examiner* — Nicholas E Igbokwe
(74) *Attorney, Agent, or Firm* — Caesar Rivise, PC

(57) ABSTRACT

A flexible side-gusseted package and methods of making the same are disclosed. The package has a central longitudinal axis, a front panel, a back panel, and a pair of gusseted side panels. The front panel is secured to the gusseted side panels along a pair of side seal lines. The back panel is secured to the gusseted side panels along a pair of side seal lines. Each of the seal lines includes a pair of end portions and an intermediate portion. The intermediate portion, e.g., a concave recessed portion, of each side seal line is located closer to the central longitudinal axis than the end portions of the side seal lines to provide a package which is somewhat necked-down at its middle, to facilitate grasping of the package by users.

7 Claims, 14 Drawing Sheets

Related U.S. Application Data

(60) Provisional application No. 61/566,847, filed on Dec. 5, 2011.

(51) Int. Cl.

| | |
|---|---|
| ***B31B 70/60*** | (2017.01) |
| ***B65B 43/04*** | (2006.01) |
| ***B65B 43/06*** | (2006.01) |
| ***B65B 43/08*** | (2006.01) |
| ***B65D 75/00*** | (2006.01) |
| ***B31B 70/18*** | (2017.01) |
| ***B31B 70/26*** | (2017.01) |
| *B31B 150/00* | (2017.01) |
| *B31B 155/00* | (2017.01) |
| *B31B 160/30* | (2017.01) |
| *B31B 160/20* | (2017.01) |

(52) U.S. Cl.
CPC ..... *B65B 43/06* (2013.01); *B65B 43/08* (2013.01); *B65D 75/008* (2013.01); *B31B 70/18* (2017.08); *B31B 70/266* (2017.08); *B31B 2150/00* (2017.08); *B31B 2150/002* (2017.08); *B31B 2155/00* (2017.08); *B31B 2155/002* (2017.08); *B31B 2160/20* (2017.08); *B31B 2160/30* (2017.08)

(58) Field of Classification Search
CPC ... B31B 2160/30; B31B 70/266; B31B 70/60; B65B 9/08; B65B 9/087; B65B 9/093; B65B 43/04; B65B 43/06; B65B 43/08
USPC ..... 53/452, 558, 455, 562
See application file for complete search history.

(56) References Cited

U.S. PATENT DOCUMENTS

| | | | | |
|---|---|---|---|---|
| 4,554,192 | A * | 11/1985 | Benoit | B65D 31/10 206/390 |
| 5,772,332 | A * | 6/1998 | Geller | B29C 65/18 220/9.1 |
| 5,952,025 | A * | 9/1999 | Yannuzzi, Jr. | B32B 29/00 383/109 |
| 5,967,313 | A | 10/1999 | Gabriel | |
| D436,848 | S | 1/2001 | Berman | |
| D437,549 | S | 2/2001 | Berman | |
| D446,445 | S | 8/2001 | Croft et al. | |
| D454,487 | S | 3/2002 | Bell et al. | |
| D474,683 | S | 5/2003 | Berman | |
| D475,614 | S | 6/2003 | Jones | |
| 6,672,762 | B1 * | 1/2004 | Faircloth | B65D 5/029 206/278 |
| D486,731 | S | 2/2004 | Meeker et al. | |
| 6,783,277 | B2 * | 8/2004 | Edwards | B65D 31/005 383/104 |
| 7,018,099 | B2 | 3/2006 | Caudle | |
| D523,758 | S | 6/2006 | Risgalla | |
| D527,278 | S | 8/2006 | Ueda | |
| D548,613 | S | 8/2007 | Miller et al. | |
| D558,047 | S | 12/2007 | Pinkstone | |
| D560,122 | S | 1/2008 | Fuchs et al. | |
| D581,808 | S | 12/2008 | Schwartz | |
| 7,458,195 | B2 | 12/2008 | Bezek et al. | |
| D584,168 | S | 1/2009 | Murray | |
| 7,665,895 | B2 * | 2/2010 | Takita | B65D 33/02 383/107 |
| D619,018 | S | 7/2010 | Karay et al. | |
| 7,819,582 | B2 | 10/2010 | Rosen | |
| 7,908,829 | B2 | 3/2011 | Ligon et al. | |
| D684,853 | S | 6/2013 | Dagnino | |
| 8,540,427 | B2 | 9/2013 | Steele | |
| 2002/0126921 | A1 | 9/2002 | Bell | |
| 2009/0056281 | A1 | 3/2009 | Murray | |
| 2009/0154845 | A1 * | 6/2009 | Kerr | B65D 33/25 383/64 |
| 2011/0146208 | A1 | 6/2011 | Ligon et al. | |

* cited by examiner

METHODS OF MAKING GUSSETED FLEXIBLE PACKAGE WITH SHAPED SIDES

CROSS-REFERENCE TO RELATED APPLICATIONS

This application is a divisional of U.S. Application, Ser. No. 13/692,139, filed on Dec. 3, 2012, entitled GUSSETED FLEXIBLE PACKAGE WITH SHAPED SIDES AND METHODS OF MAKING THE SAME, which in turn claims priority from Provisional Application Ser. No. 61/566,847, filed on Dec. 5, 2011, entitled GUSSETED FLEXIBLE PACKAGE WITH SHAPED SIDES AND METHODS OF MAKING THE SAME, both of which applications are assigned to the same assignee as this application and whose disclosures are specifically incorporated by reference herein.

BACKGROUND OF THE INVENTION

This invention relates to flexible packages and more particularly to gusseted flexible packages and methods of making the same.

Various types of stand-up flexible packages are known for storing liquids, granular, powders and the like. One such package is the so-called side-gusseted package. It is typically formed from a web of flexible stock material, e.g., polyethylene, polyester, polypropylene, metal foil, and combinations thereof in single or multiple plies, into a tubular body, having a front panel, a back panel, and a pair of gusseted sides. Each gusseted side is formed by a pair of gusset sections and a central fold edge. The lower end of the package is commonly permanently sealed, e.g., heat sealed, along a line extending transversely across the width of the bag close to its bottom edge. The top of the package is commonly sealed transversely across the entire width of the package in a number of ways to maintain the contents under vacuum until the package is opened. One example of a side-gusseted package is a bag typically used for packaging coffee. That side-gusseted bag is made from a flexible packaging laminate composed of various layers of plastic films, metal foils and papers bonded together using adhesives and extrusions. The flexible packaging laminate is generally printed or labeled for the package contents and other consumer information. The flexible packaging laminate is normally produced as sheeting wound onto a roll or rolls which is used to form many packages. The flexible package is formed from the laminate using conventional equipment such as pre-made bag machines, vertical form-fill-seal machines, horizontal form-fill-seal machines and other well known equipment. These machines fold a sheet or sheets of the flexible laminate and seal together some of the edges and leaving a filling mouth. The package is then filled through the mouth and then sealed across the filling mouth to complete the package. The formed and filled side-gusseted package generally takes the shape of a parallelepiped or six-faced polyhedron, though at times the package top may also take the form of a triangular prism.

As is known package retailers tend to keep the package height at a maximum of 12-14 inches in order to maximize the number of shelves for product display. In order to meet the height restriction, package designers must increase the package width and depth in order to hold the required package contents. The problem with these packages is the difficulty in handling the package by the consumer, especially when attempting to pick the package up using one hand.

Other types of flexible packages are available to provide easier handling. For example, flat pouches have been made in die-cut shapes. These flat pouches can also have a gusset inserted into the bottom to form a shaped stand-up pouch. However, such shaped flat and bottom gusseted stand-up pouches do not provide the volume or depth that is provided by a side-gusseted package.

Thus, there is a need for a side-gusseted package which can be permit simple one-handed grasping of the package and still keep the package height restricted as required by retailers. The subject invention addresses that need.

SUMMARY OF THE INVENTION

One aspect of this invention constitutes methods of making a plurality of side-gusseted flexible packages. One such method basically entails forming a web of flexible material into a tubular member having a central longitudinal axis and a plurality of sequentially located sections extending along the central longitudinal axis. Each of the sections is arranged to be formed into a respective one of the side-gusseted flexible packages (e.g., is a precursor of the package). Each of the side-gusseted flexible packages comprises a front panel, a back panel, and a pair of gusseted side panels, with the front panel having a first side edge, a second side edge, a top edge and a bottom edge, and with the back panel having a first side edge and a second side edge, a top edge and a bottom edge. Each of the gusseted side panels comprises pair of gusset sections connected to each other by a fold line, with one of the pair of gusseted side panels being connected between the first side edge of the front panel and the first side edge of the back panel, with the other of the pair gusseted side panels being connected between the second side edge of the front panel and the second side edge of the back panel. Portions of the front panel are sealed to portions of the gusseted side panels along respective front panel seal lines at the front panel side edges. Each of the front panel seal lines has an end edge portion and an intermediate edge portion. The intermediate edge portions of the front panel seal lines are located closer to the central longitudinal axis than the end edge portions thereof. Portions of the back panel are sealed to portions of the gusseted side panels along respective back panel seal lines at the back panel side edges. Each of the back panel seal lines has an end edge portion and an intermediate edge portion, with the intermediate edge portions of the back panel seal lines being located closer to the central longitudinal axis than the end edge portions thereof. Portions of the package are cut immediately outside the front and back panel seal lines to produce the side edges of the package and the bottom edges of the front and real panels are sealed together along a bottom seal line. The package may be filled with a product and then sealed by a seal line extending across the top edges of the front and back panels.

Another method of making a side-gusseted flexible package in accordance with this invention entails forming a front panel and a back panel from a web of flexible material. The front panel has a first side edge, a second side edge, a top edge a bottom edge and a central longitudinal axis located midway between the first and second side edges of the front panel. The back panel has a first side edge and a second side edge, a top edge, a bottom edge and a central longitudinal axis located midway between the first and second side edges of the back panel. A pair of tubes is formed from a web of flexible material, with each of the tubes of the pair having a longitudinal axis and an outer surface. A portion of the outer surface of the pair of tubes is adhesively secured to the back panel with the tubes being spaced from each other and with the longitudinally axes of the tubes extending parallel to the central longitudinal axis of the back panel. The front panel is disposed over the back panel and on portions of the pair of tubes to form a pair of gusseted side panels. Portions of the front panels are sealed to portions the tubes along a pair of front panel seal lines and portions of the back panels are sealed to portions of the tubes along a pair of back panel seal lines to form a body having a pair of gusseted side panels and a central longitudinal axis. The central longitudinal axis is located midway between the gusseted side panels. Each of the gusseted side panels comprises a pair of gusset sections connected to each other by a fold line. Each of the front panel seal lines has an end edge portion and an intermediate edge portion with the intermediate edge portions of the front panel seal lines being located closer to the central longitudinal axis than the end edge portions thereof. Portions of the package immediately outside the front and rear panel seal lines are cut to form the side edges of the package. The bottom edges of the front and back panels are sealed together along a bottom seal line to form a hollow, side-gusseted package having an open top. The package may be filled with a product and then sealed by a seal line extending across the top edges of the front and back panels.

DETAILED DESCRIPTION OF THE PREFERRED EMBODIMENT

Figure 1:
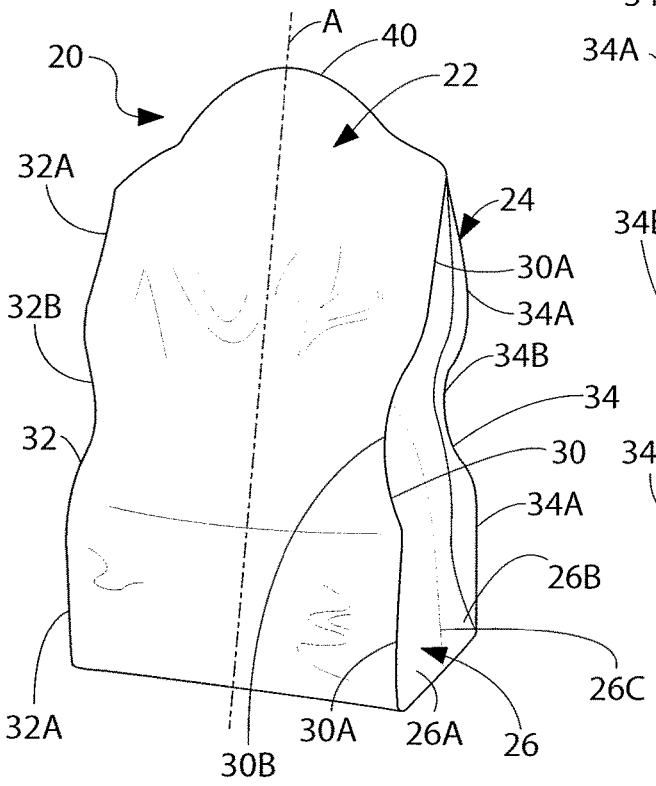
FIG. 1 is a front isometric view of one exemplary side-gusseted package constructed in accordance with this invention.
Figure 2:
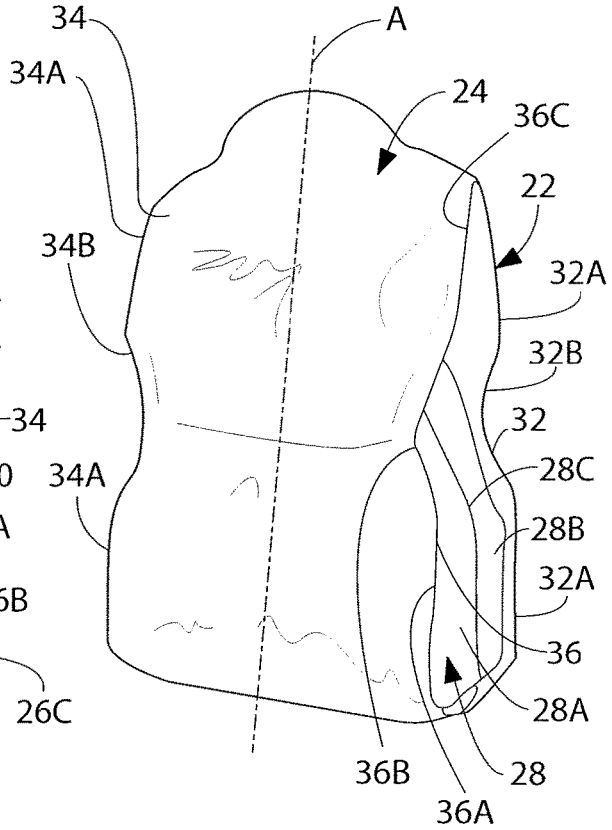
FIG. 2 is a rear isometric view of the package shown in FIG. 1.
Figure 3:
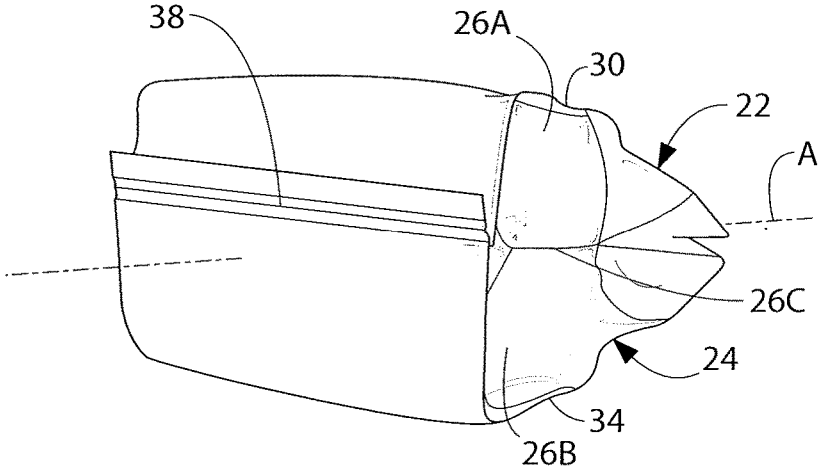
FIG. 3 is an isometric view of the package of FIG. 1, but shown from the bottom.
Figure 4:
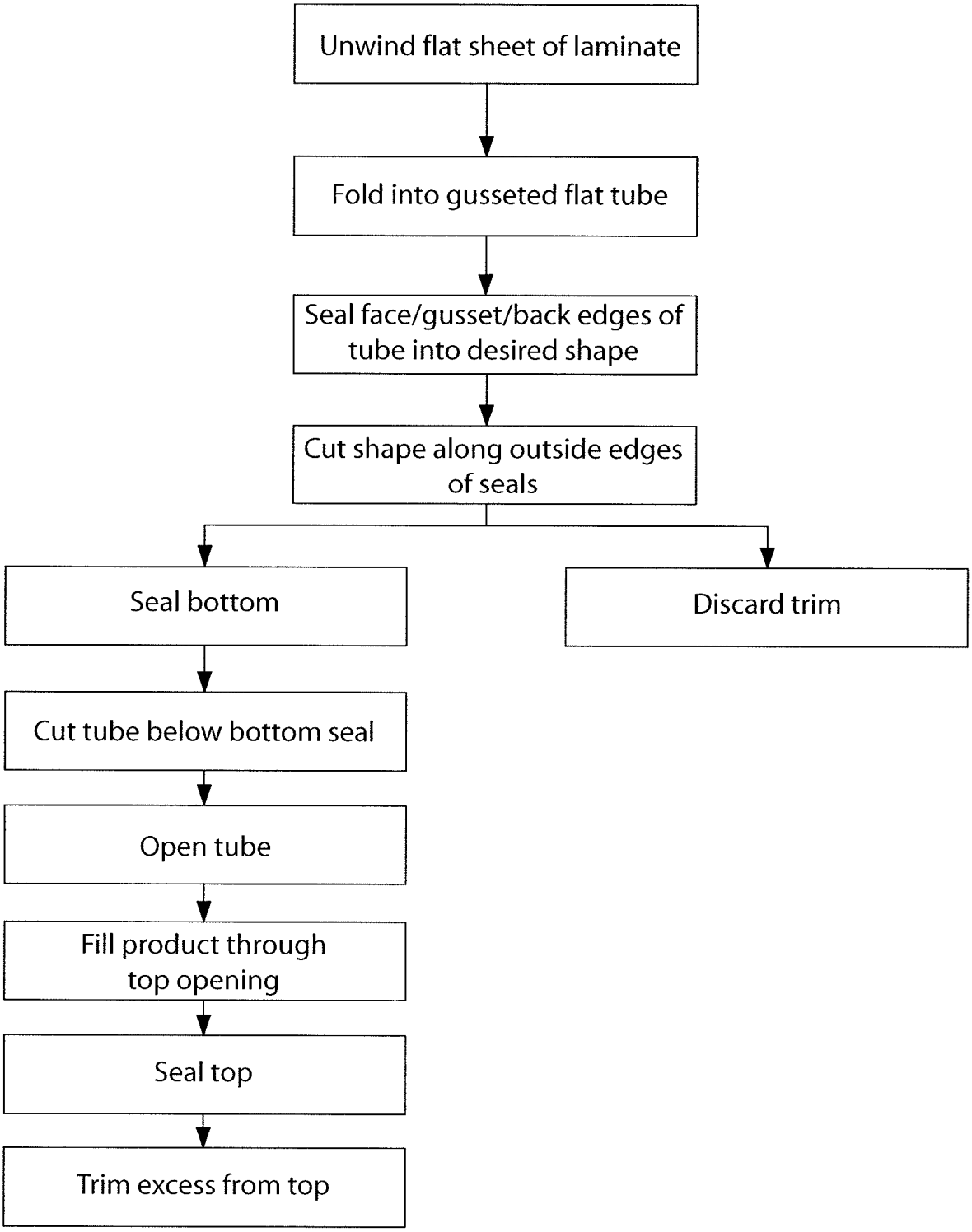
FIG. 4 is a flow diagram showing the steps of one method of making a series of packages like shown in FIGS. 1-3.

Referring now to the various figures of the drawing wherein like reference characters refer to like parts, there is shown at 20 in FIG. 1 one exemplary embodiment of a side-gusseted package constructed in accordance with this invention. The package has a central longitudinal axis A and basically comprises a front panel 22, a back or rear panel 24, a first side gusset panel 26 and a second side gusset panel 28 which are fixedly secured, e.g., heat or ultrasonically sealed, to one another. In particular, as best seen in FIGS. 1 and 2, one side edge of the front panel 22 is fixedly secured to a front edge of the first side gusset panel 26 along a seal line 30 and another side edge of that front panel is fixedly secured to a front edge of the second side gusset panel 28 along a seal line 32. The back panel 24 is of the same shape and size as the front panel 22. One side edge of the back panel 24 is fixedly secured to a rear edge of the first side gusset panel 26 along a seal line 34 and another side edge of that back panel is fixedly secured to a rear edge of the second side gusset panel 28 along a seal line 36. The front panel 22, the back panel 24 and the lower edges of the two side gusset panels 26 and 28 are fixedly secured along a bottom seal line 38 (FIG. 3), which is preferably linear. The front panel 22, the back panel 24 and the upper edges of the two side gusset panels 26 and 28 are fixedly secured along a top seal line 40. The top seal line is shown as being arcuate, but could if desired be of any other shape, e.g., linear, so long as it extends across the top of the package.

As will be seen in the discussion to follow, when the package 20 is made, there will be a point where all of its side seals and its bottom seal will have been completed, to thereby create a hollow body having an open top. It is through that open top that the contents of the package, e.g., any product, such as coffee, etc., can be introduced. Once the package is filled with the product the top portion of the package is sealed to enclose the product within the package.

In order to render the package suitable to be readily grasped by a user, the side seals lines 30, 32, 36 and 26 are not linear (as has characterized prior art side-gusseted packages), but rather are somewhat necked down at approximately their mid-portion. To that end, the seal line 30 includes a pair of end edge portions 30A and an intermediate edge portion 30B. The end edge portions 30A are preferably linear (but may be arcuate), while the intermediate edge portion 30B is preferably concave, e.g., an inwardly extending arcuate shape, but can be of other shapes. In a similar manner the seal line 32 includes a pair of linear end edge portions 32A and a concave intermediate edge portion 32B. Thus, the intermediate edge portions 30B and 32B of the two front panel side seals are located closer to the central axis A, than the end edge portions 30A and 32A of those seal lines. In a similar manner, the seal line 34 includes a pair of linear end edge portions 34A and a concave intermediate edge portion 34B, while the seal line 36 includes a pair of linear end edge portions 36A and a concave intermediate edge portion 36B. Thus the intermediate edge portions 34B and 36B of the two back panel side seals are located closer to the central axis A, than the end edge portions 34A and 36A of those seal lines.

As best seen in FIGS. 1 and 2 each of the gusseted side panels comprises pair of gusset sections connected to each other by a fold line. In particular, the gusset panel 26 includes a gusset section 26A and a gusset section 26B connected to each other by a fold line 26C. In a similar manner the gusset panel 28 includes a gusset section 28A and a gusset section 28B connected to each other by a fold line 28C.

Figure 5:
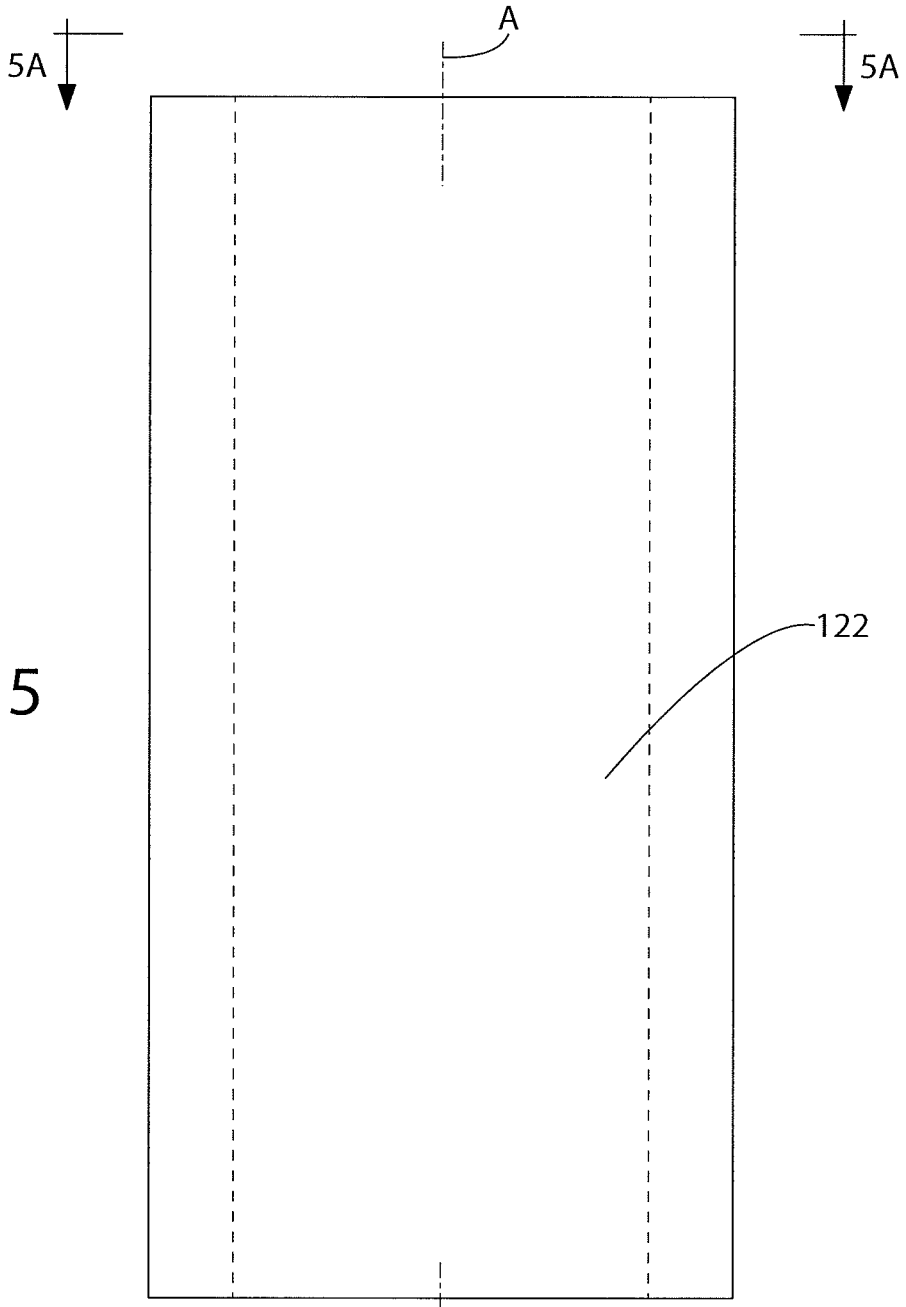
FIG. 5 is a plan view of a portion of a web of flexible packaging material which has been formed into a folded tube having plural sequentially located sections, each of which is arranged to be formed into a respective side-gusseted flexible package, with each of those packages having a front panel, a pair of side gussets, and a back panel, in accordance with a method step shown in the flow diagram of FIG. 4.
Figure 5A:
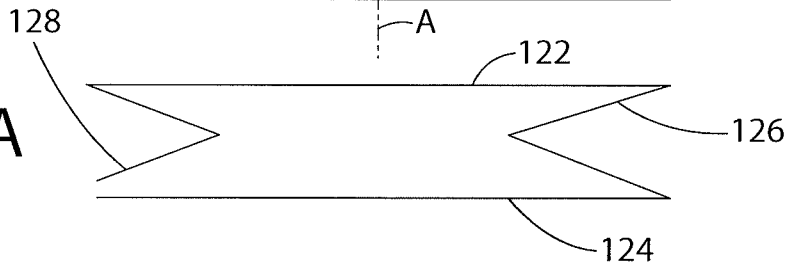
FIG. 5A is a cross sectional view of the folded tube taken along lines 5A-5A of FIG. 5.
Figure 6:
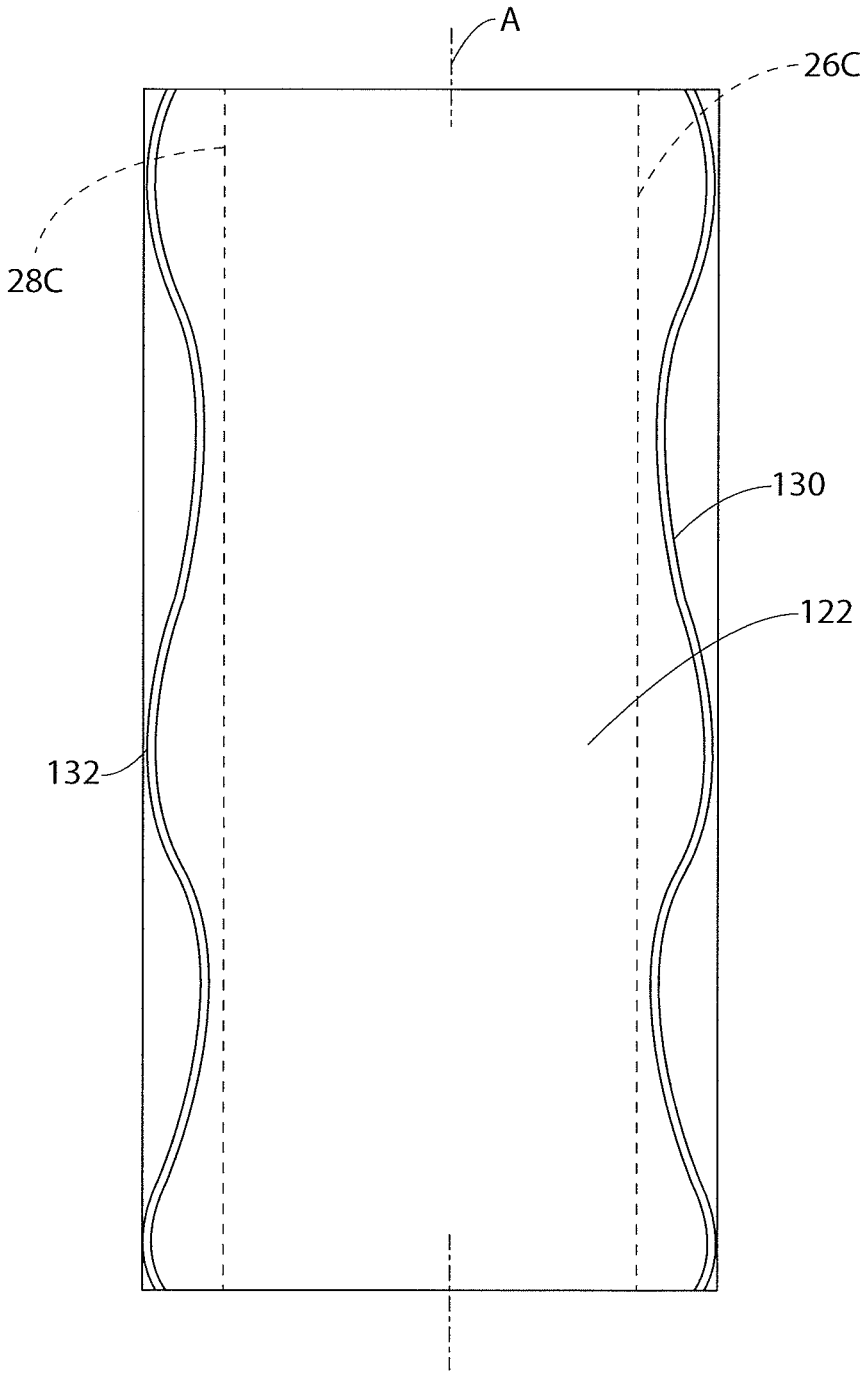
FIG. 6 is a plan view of the folded tube shown in FIG. 5, but after the front and back panels and interposed side gussets of a series of sequentially located sections have been sealed along respective seal lines in accordance with a method step shown in the flow diagram of FIG. 4.

Turning now to FIGS. 4-13, one exemplary embodiment of a method of producing plural side-gusseted packages 20 will now be described. The entire method is depicted in the flow or block diagram of FIG. 4 and in the corresponding FIGS. 5-13, showing the sequential steps in the process. To that end, a web of any suitable flexible packaging material, e.g., a laminate, is unwound from a supply of that material and is formed into a folded tube like shown in FIGS. 5 and 5A. The tube includes a front face 122 (which will become the front panels 22 of the series of packages), a back face 124 (which will become the back panels 24 of the series of packages), a first gusseted side 126 (which will become the first side gusset panels 26 of the series of packages), and a gusseted side 128 (which will become the second side gusset panels 28 of the series of packages).

Figure 7:
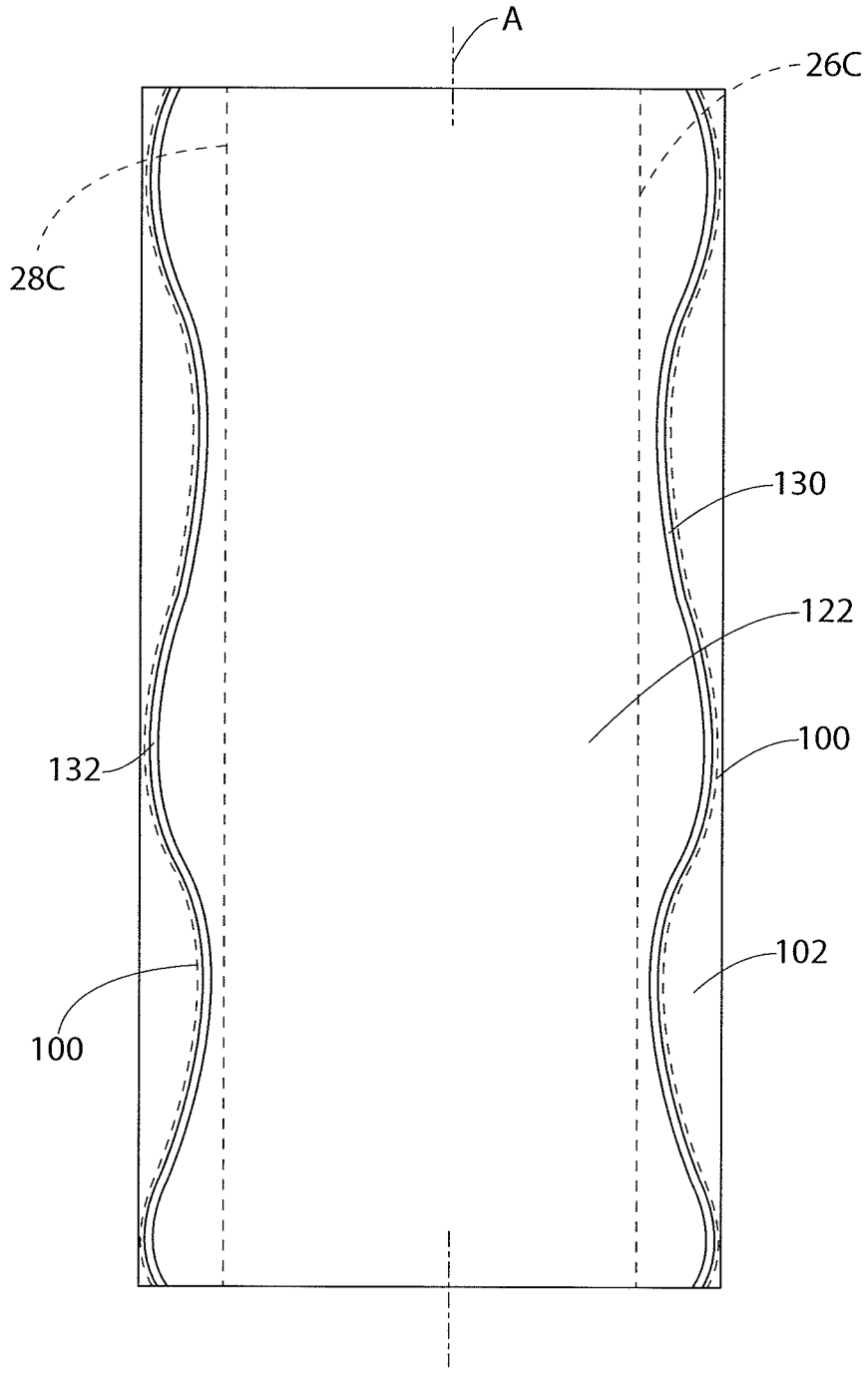
FIG. 7 is a plan view of the folded, sealed tube shown in FIG. 6, but after portions of the front, back and side gussets of the series of sequentially located sections have been die-cut along lines immediately outside of the seal lines in accordance with a method step shown in the flow diagram of FIG. 4.
Figure 8:
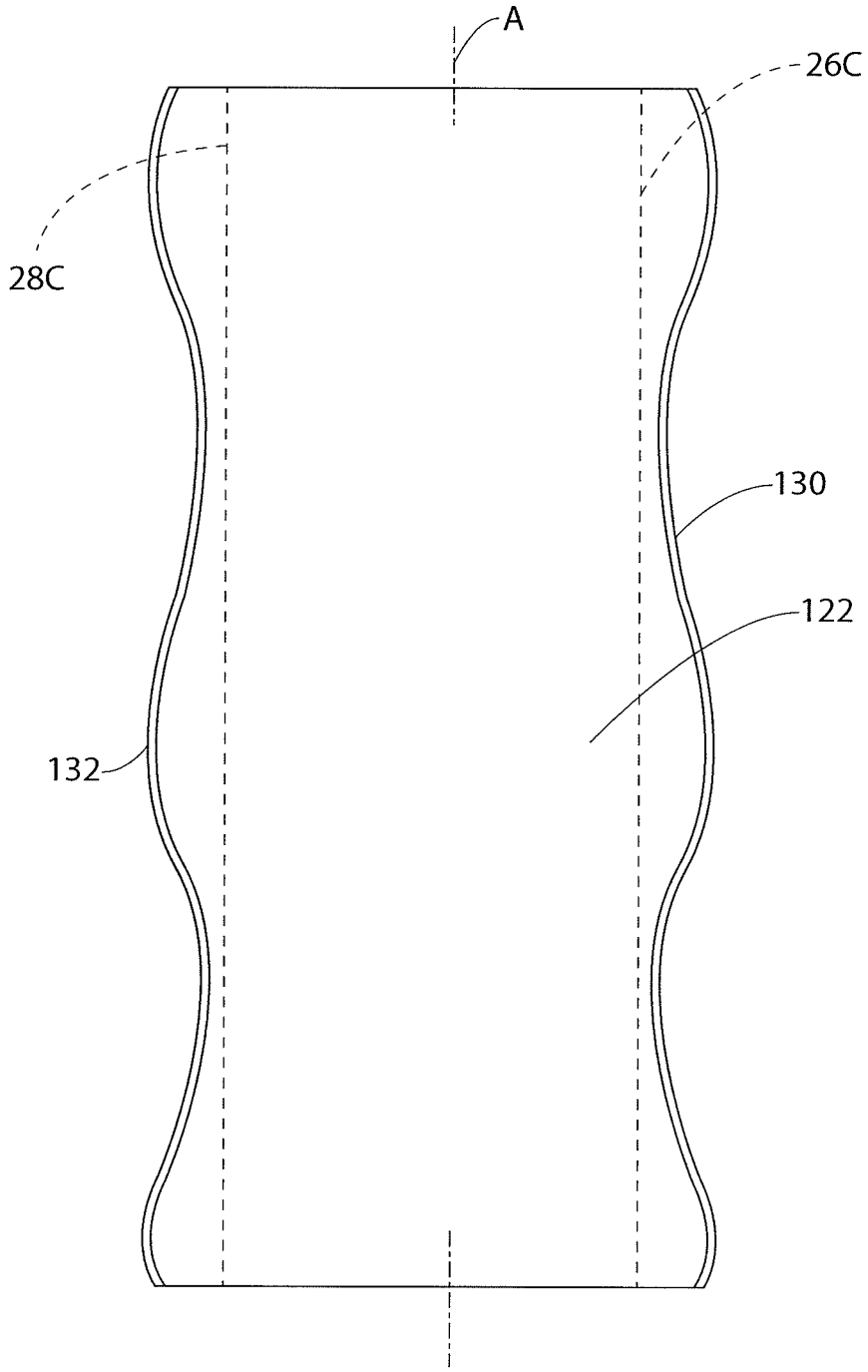
FIG. 8 is a plan view of the folded, sealed tube shown in FIG. 7, but after the die-cut portions of the sequentially located sections of the tube have been discarded in accordance with a method step shown in the flow diagram of FIG. 4.
Figure 9:
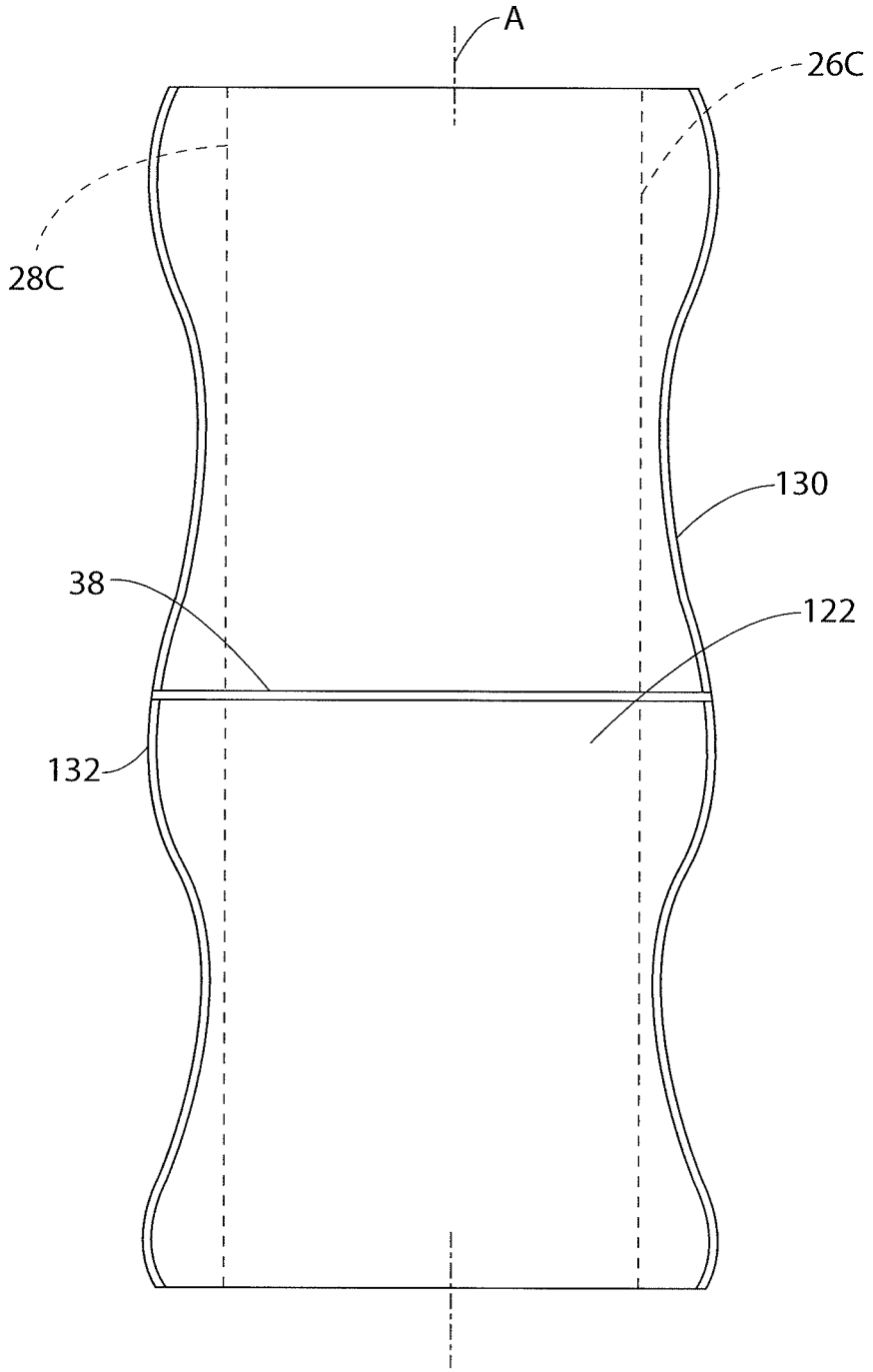
FIG. 9 is a plan view of the die-cut sealed tube shown in FIG. 8, but after a bottom seal line has been formed between two sequentially located die-cut sections of the tube in accordance with a method step shown in the flow diagram of FIG. 4.
Figure 10:
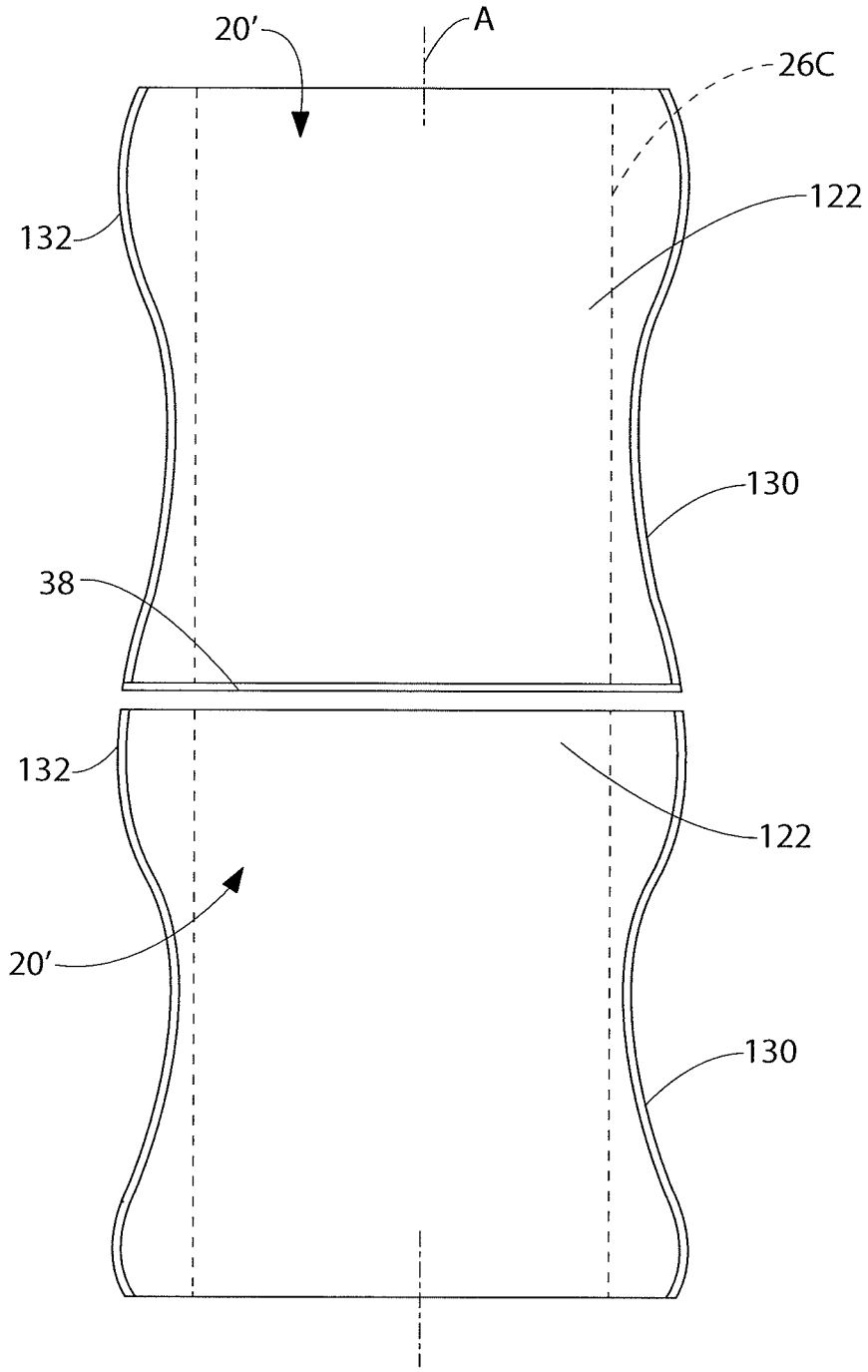
FIG. 10 is a plan view of the die-cut sealed tube shown in FIG. 9, but after a the tube has been die cut below the bottom seal line of the upper section to thereby separate a section from the tube to form a package to be filled with a product in accordance with a method step shown in the flow diagram of FIG. 4.
Figure 13:
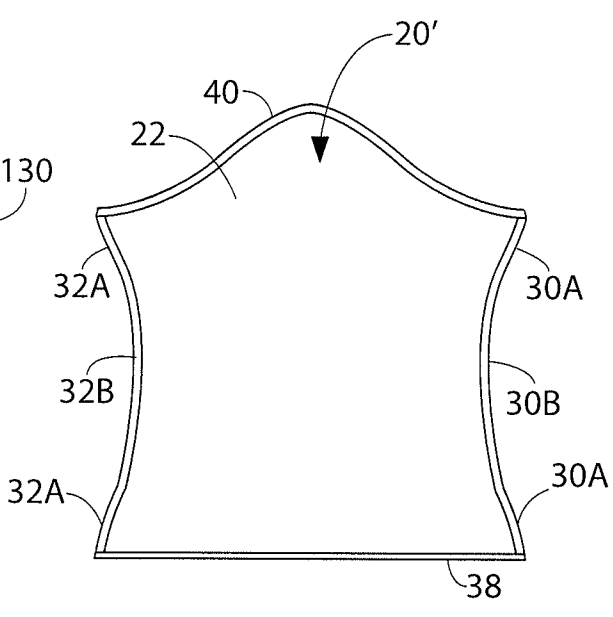
FIG. 13 is a plan view of the filled, sealed package shown in FIG. 12 but after portions of the front, back and side gussets of that package have been die-cut along lines immediately outside of the top end seal line and discarded to complete the package in accordance with a method step shown in the flow diagram of FIG. 4.
Figure 12:
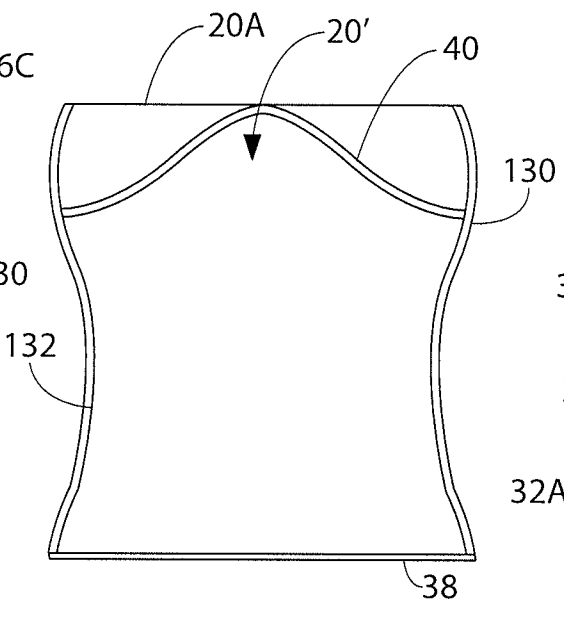
FIG. 12 is a plan view of the filled package shown in FIG. 11 after its top end has been sealed to close off the package in accordance with a method step shown in the flow diagram of FIG. 4.

Portions of the front face 122 are then sealed to the adjacent portions of the gusseted sides 126 and 128 along seal lines 130 and 132, respectively, (which will become the seal lines 30 and 32 of the series of packages). At the same time portions of the back face 124 are sealed to the adjacent portions of the gusseted sides 126 and 128 along similar seal lines (not shown, and which will become the seal lines 34 and 36 of the series of packages). Once the seals are completed the sealed tube is die cut along die-cut lines 100, which are immediately adjacent and outside of the side seal lines as shown in FIG. 7. The portions of the tube located outside of the seal line are designated by the reference number 102 and serve as the trim, so that they are discarded leaving the tube as shown in FIG. 8. A transverse seal 38, which serves as the bottom seal line of the package, is then applied across the width of the tube at longitudinally spaced locations along the central longitudinal axis A as shown in FIG. 9. The spacing between the transverse seal lines effectively establishes a series of sequentially located tube sections, each of which is the precursor to the formation of a respective package 20. The tube is then die-cut along a line immediately below each transverse seal line as shown in FIG. 10. This results in a hollow body 20', like shown in FIG. 11. The top portion 20A of the hollow body 20' is open, i.e., unsealed at this time, so that it serves as a mouth through which a product (not shown) can be introduced into the hollow interior of the body. Once the body 20' is filled, the top portion is sealed by the top seal line 40 (which extends transversely across the body) to enclose the product within the body as shown in FIG. 12. Once the product is sealed within the body, the portions of the body immediately above the top seal line are die-cut and discarded as trim, resulting in a completed package 20, such as shown in FIG. 13.

Figure 15:
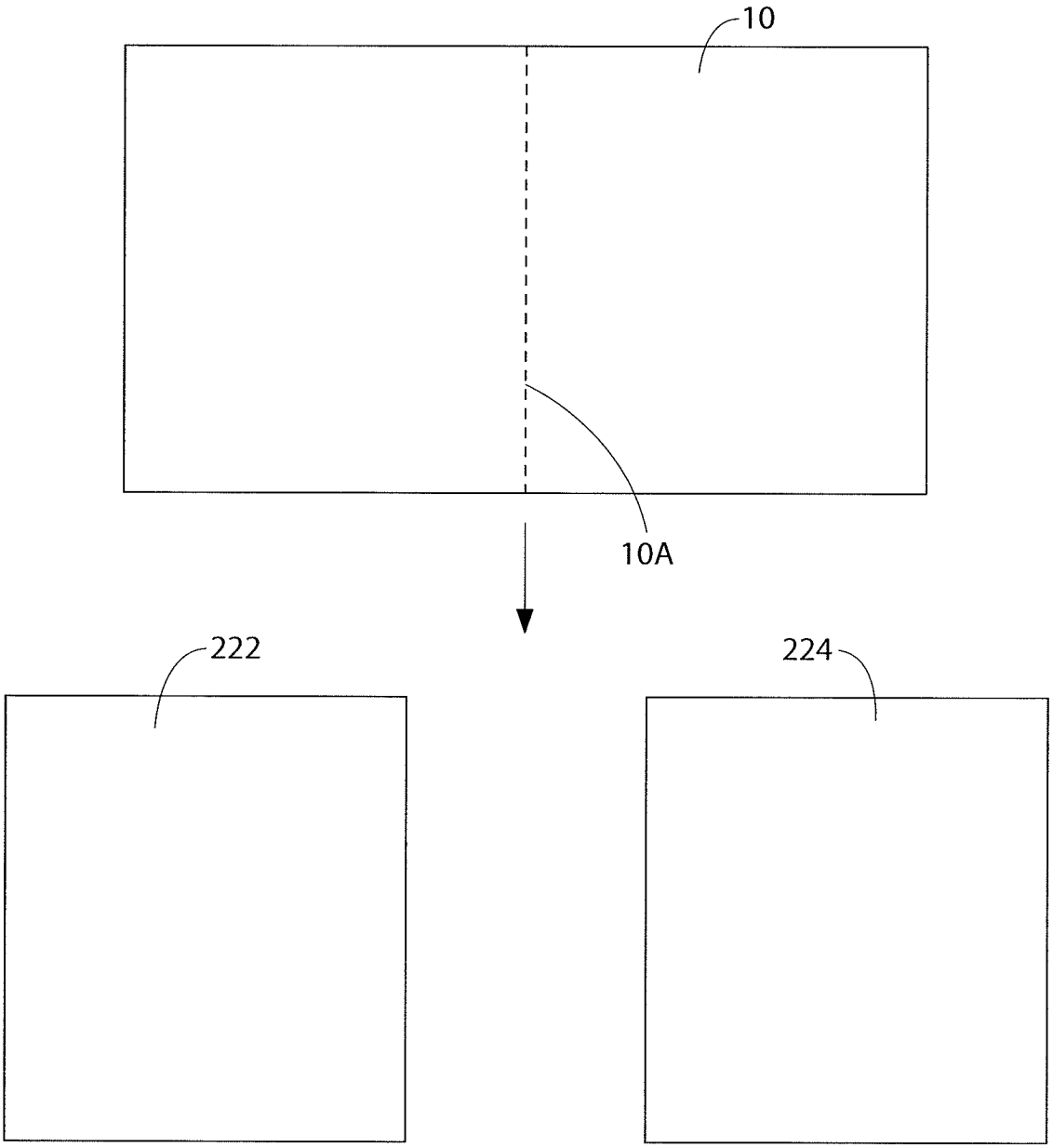
FIG. 15 is a plan view of a portion of a web of flexible packaging material which has been slit into two web sections for forming a series of front and back panels for a series of packages in accordance with a method step shown in the flow diagram of FIG. 14.
Figure 16:
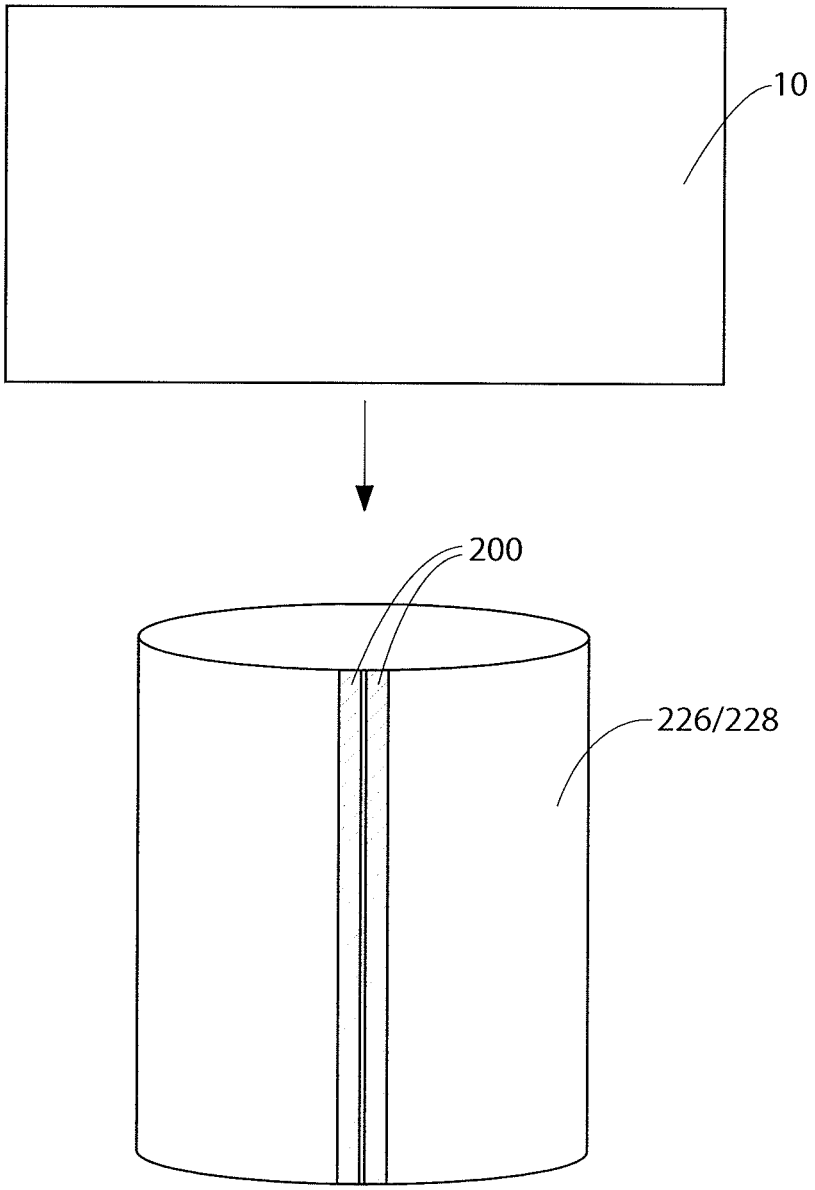
FIG. 16 is a combined plan and isometric view of a portion of a web of flexible packaging material shown forming one tube of a plurality of tubes for use with the front and back panels shown of FIG. 15 for producing a series of package in accordance with a method step shown in the flow diagram of FIG. 14.
Figure 17:
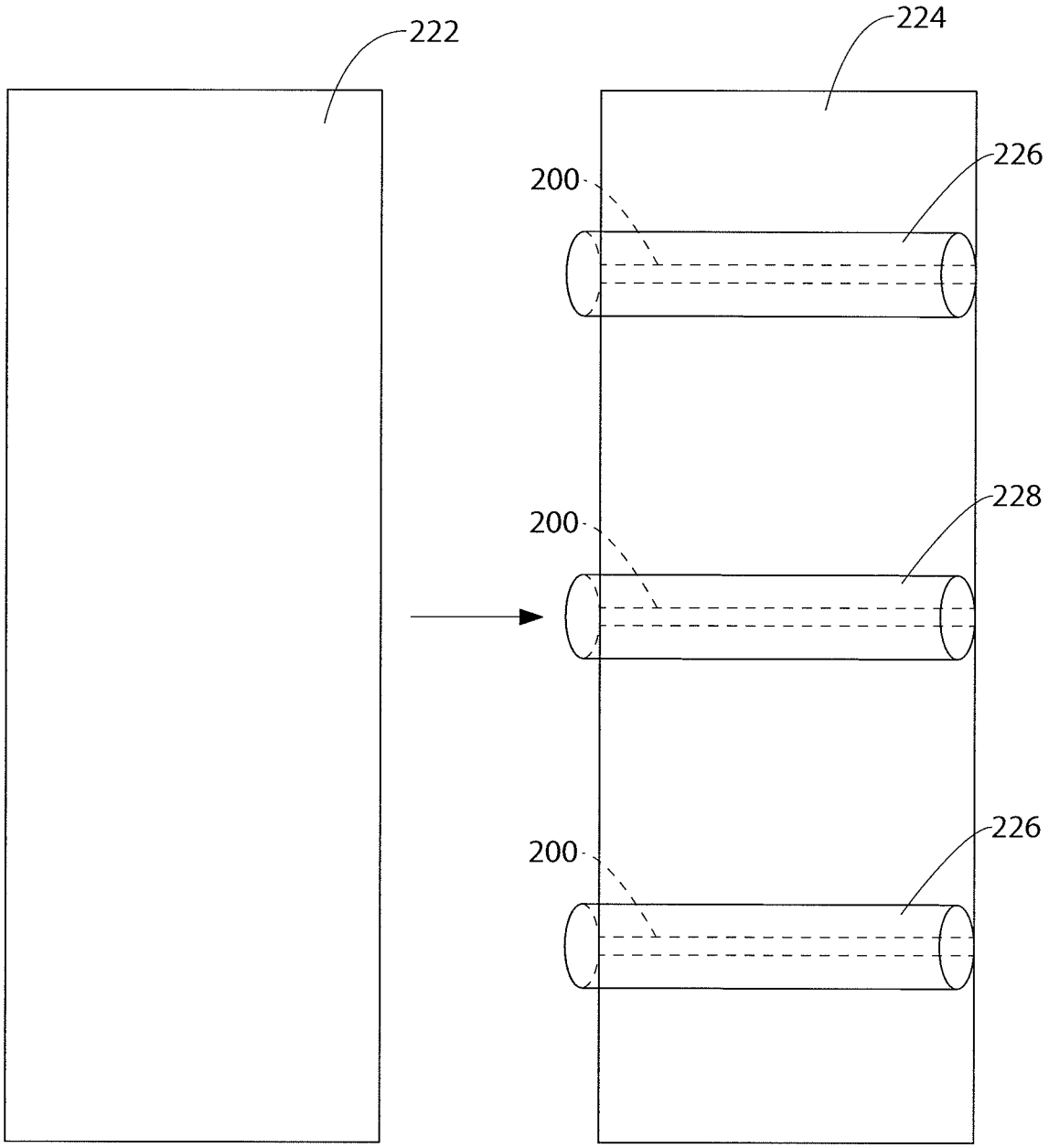
FIG. 17 is a combined plan and isometric view of a portion of the web of flexible packaging material making up a series of sequentially located back panels on which a plurality of tubes like that shown in FIG. 16 have been disposed, and a portion of the web of flexible packaging material making up a series of sequentially located front panels arranged for disposition over the web of back panels to produce a series of packages in accordance with a method step shown in the flow diagram of FIG. 14.

Turning now to FIGS. 14-22, another exemplary embodiment of a method of producing plural side-gusseted packages 20 will now be described. The entire method is depicted in the flow or block diagram of FIG. 14 and in the corresponding FIGS. 15-19 and 11-13, showing the sequential steps in the process. To that end, a web of any suitable flexible packaging material 10, e.g., a laminate, is unwound from a supply of that material and is slit longitudinally in half along line 10A as shown in FIG. 15 to result in two web sections 222 and 224. Each of these sections is the precursor of a series of front and back panels to form a series of packages 20, thus the sections 222 and 224 of indeterminate length. Another web of any suitable flexible packaging material 10, e.g., a laminate, is unwound from a supply of that material and as shown in FIG. 16 is formed into a plurality of tubes 226 and 228. These tubes serve as precursors of the side gusset panels 26 and 28 of the package. As can be seen in FIG. 16 an adhesive strip 200, e.g., tape, is unwound from a supply reel and applied to the outer surface of the tubes 226/228 along the abutting longitudinal marginal edges of those tubes to hold the tubes together. The tubes are then disposed on the back web section 224 at spaced locations therealong and are tacked thereon to hold the tubes in place as shown in FIG. 17. The front web section 222 is then juxtaposed over the back rear section and is tacked in place thereon to result in an assembly like shown in FIG. 18.

Figure 18:
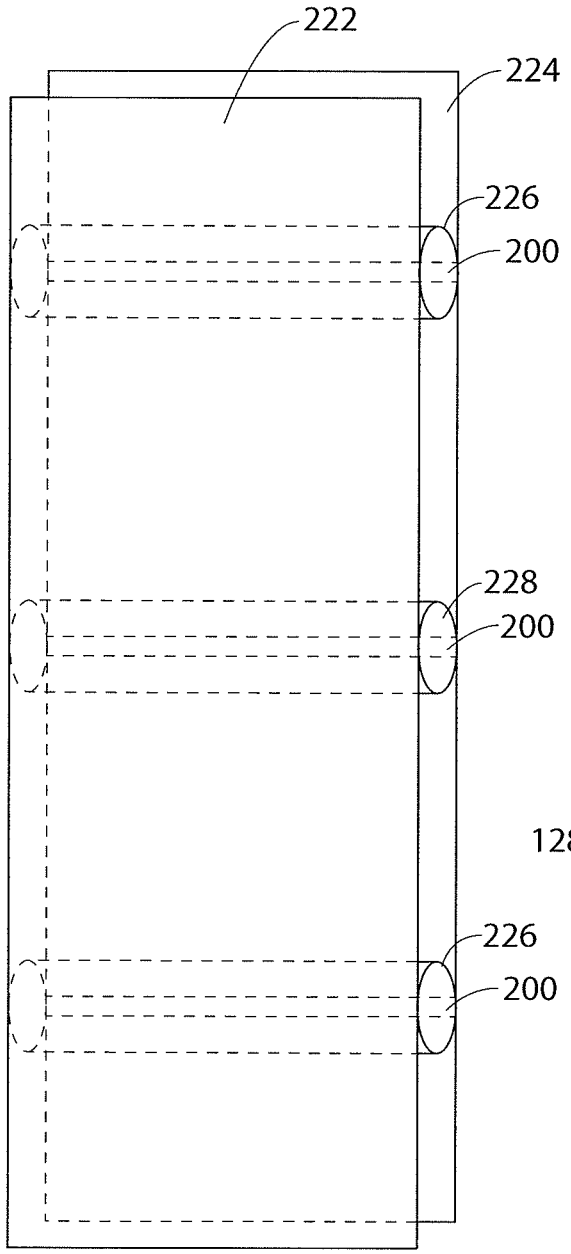
FIG. 18 is an isometric view of a portion of the web of sequentially located front panels disposed over the portion of the web of sequentially located back panels with the plural tubes interposed therebetween and tacked thereto to produce an assembly from which a series of packages are produced in accordance with a method step shown in the flow diagram of FIG. 14.
Figure 19:
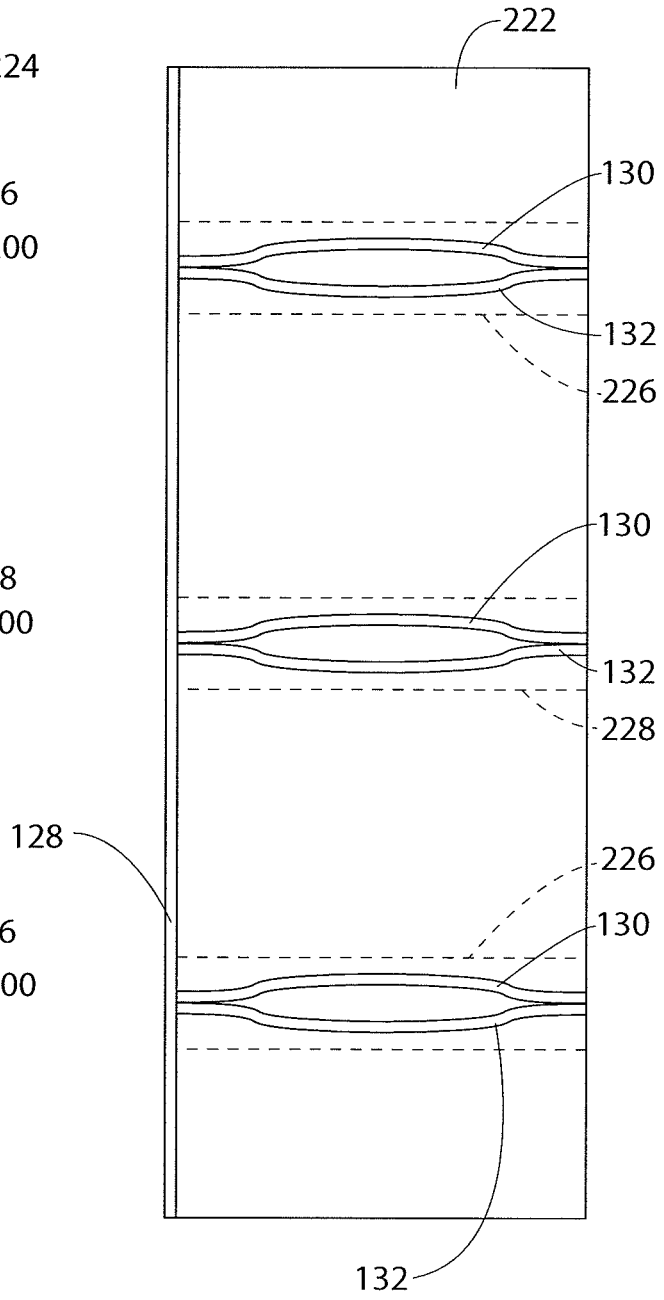
FIG. 19 is a plan view of the assembly of FIG. 18 but showing that assembly after the sequentially located sections forming the front and back panels and interposed tubes (which form the side gussets) have been sealed along respective seal lines in accordance with two method steps shown in the flow diagram of FIG. 14.

The assembly of FIG. 18 is then sealed along plural seal lines 130, 132 to join the front web section to the underlying portions of the gusset sections (the contiguous portions of the tubes 226 and 228). At the same time plural seal lines (not shown) are produced joining the back web section to the overlying portions of the gusset sections (the contiguous portions of the tubes 226 and 228). These seal lines are the precursors of the side seals 30, 32, 34 and 36 of the package. After the precursors of the side seal lines are produced a seal line 128 extending along one side of the assembly is formed. The seal line 128 is the precursor of the bottom seal 38 of the package.

Figure 11:
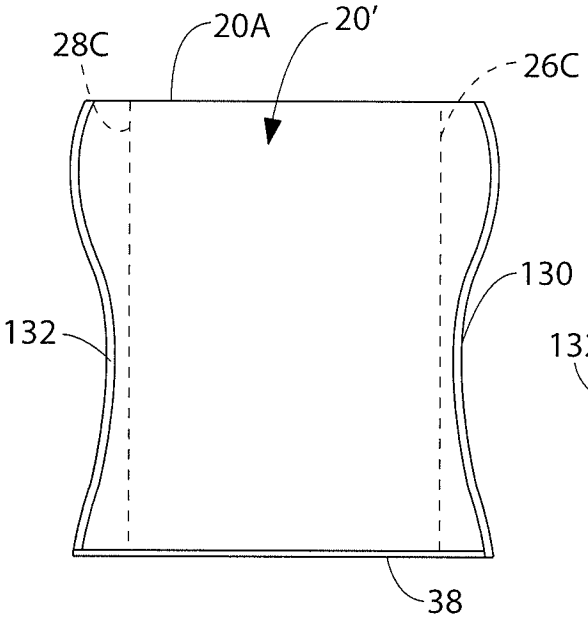
FIG. 11 is a plan view of the separated package of FIG. 10 which is filled with a product through its open top in accordance with a method step shown in the flow diagram of FIG. 4.
Figure 14:
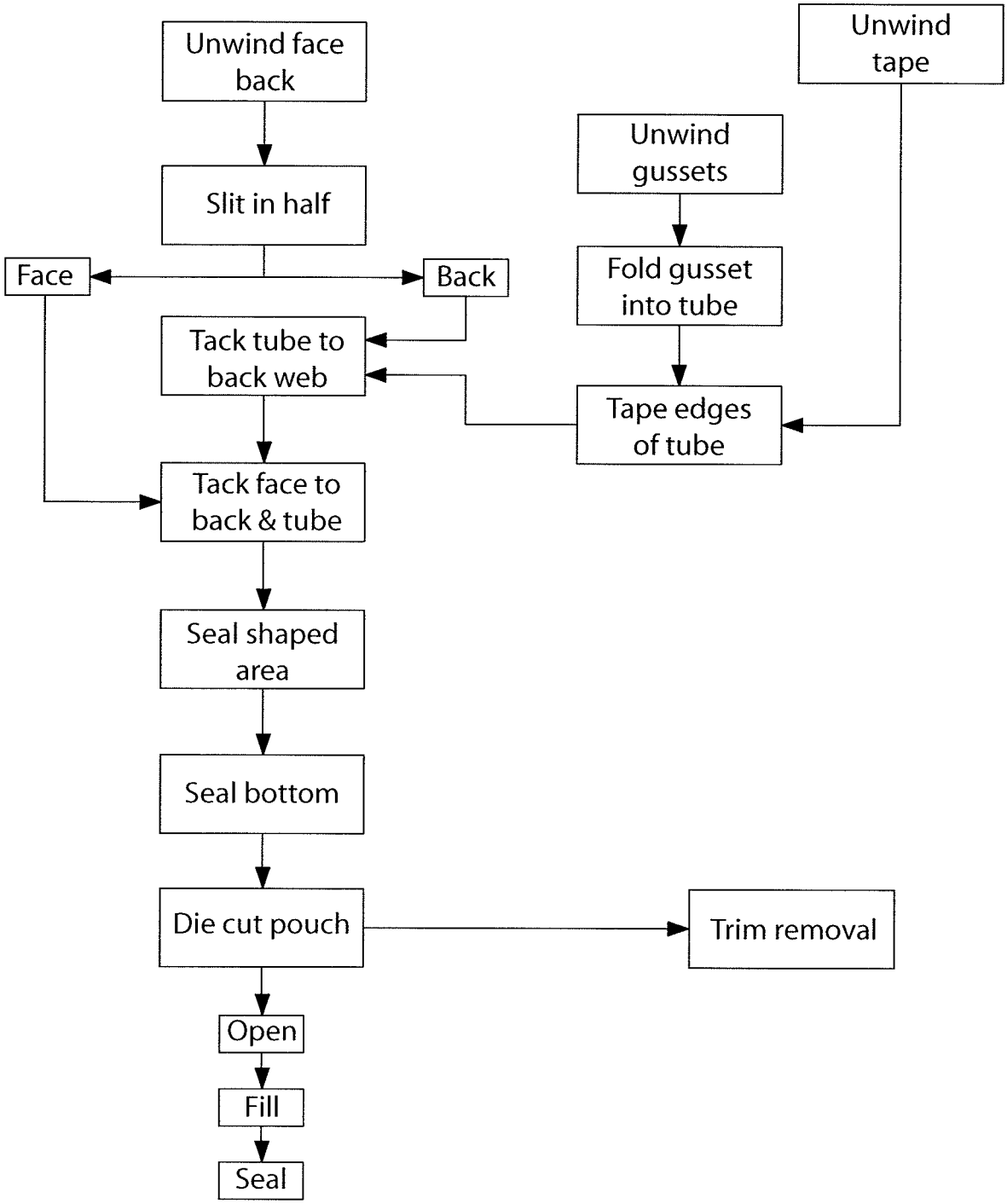
FIG. 14 is a flow diagram showing the steps of another method of making a series of packages like shown in FIGS. 1-3.

After the bottom seal line 128 has been made, the sequentially located sections of the assembly are die-cut from each other to result in a body like shown in previously described FIG. 11. The top portion 20A of the hollow body 20' is open, i.e., unsealed at this time, so that it serves as a mouth through which a product (not shown) can be introduced into the hollow interior of the body. Once the body 20' is filled the top portion is sealed by the top seal line 40 (which extends transversely across the body) to enclose the product within the body as shown in previously described FIG. 12. Once the product is sealed within the body, the portions of the body immediately above the top seal line are die-cut and discarded as trim, resulting in a completed package 20, such as shown in previously described FIG. 13.

It should be pointed out at this juncture that this invention contemplates a variety sizes and shapes of side-gusseted packages which are configured to enable ready manual handling. The packages of this invention can be used to hold any type of product and may, if desired, include a one-way valve (not shown). Such valves are commonly used in flexible packaging holding coffee to enable the coffee to degas through the valve, while preventing the ingress of air into the package.

Without further elaboration the foregoing will so fully illustrate my invention that others may, by applying current or future knowledge, adopt the same for use under various conditions of service.

I claim:

1. A method of making a plurality of side-gusseted flexible packages each having a central longitudinal axis, said method comprising:

forming a web of flexible material into a tubular member having a central longitudinal axis and a plurality of sequentially located sections extending along said central longitudinal axis, each of said sections being arranged to be formed into a respective one of said side-gusseted flexible packages, each of said side-gusseted flexible packages comprising a front panel, a back panel, and a pair of gusseted side panels, said front panel having a first side edge, a second side edge, a top edge and a bottom edge, said back panel having a first side edge and a second side edge, a top edge and a bottom edge, each of said gusseted side panels comprising pair of gusset sections connected to each other by a fold line, with one of said pair of gusseted side panels being connected between said first side edge of said front panel and said first side edge of said back panel, with the other of said pair gusseted side panels being connected between said second side edge of said front panel and said second side edge of said back panel;

sealing portions of said front panel to portions of said gusseted side panels along respective front panel seal lines at said front panel side edges, each of said front panel seal lines having an end edge portion and an intermediate edge portion, with each of said end edge portions of said front panel seal lines being immediately adjacent a respective one of said top and bottom edges and being convex in shape and with each of said intermediate edge portions of said front panel seal lines being located between said end edge portions of said front panel and being concave in shape, whereupon said intermediate edge portions of said front panel seal lines are located closer to said central longitudinal axis than said end edge portions thereof;

sealing portions of said back panel to portions of said gusseted side panels along respective back panel seal lines at said back panel side edges, each of said back panel seal lines having an end edge portion and an intermediate edge portion, with each of said end edge portions of said back panel seal lines being immediately adjacent a respective one of said top and bottom edges and being convex in shape and with each of said intermediate edge portions of said back panel seal lines being located between said end edge portions of said back panel and being concave in shape, whereupon said intermediate edge portions of said back panel seal lines are located closer to said central longitudinal axis than said end edge portions thereof;

cutting portions of said package immediately outside said front and back panel seal lines; and sealing the bottom edges of said front and back panels together along a bottom seal line.

2. The method of claim 1 additionally comprising:

cutting said web of material immediately below said bottom seal line to form a hollow side-gusseted package having an open top;

filling said hollow side-gusseted package with a product;

sealing said top edges of said front and back panels along a top seal line to thereby enclose the product within said package; and repeating said process to form, fill and seal subsequent side-gusseted packages.

3. The method of claim 2 wherein said top edge of said front panel and said top edge of said back panel are each arcuate in shape.

4. The method of claim 1 wherein said end edge portions extend generally parallel to said central longitudinal axis.

5. The method of claim 2 wherein said end edge portions extend generally parallel to said central longitudinal axis.

6. The method of claim 4 wherein said top edge of said front panel and said top edge of said back panel are each arcuate in shape.

7. The method of claim 1 wherein said top edge of said front panel and said top edge of said back panel are each arcuate in shape.

* * * * *